US005785637A

United States Patent [19]

Baptista et al.

[11] Patent Number: 5,785,637

[45] Date of Patent: Jul. 28, 1998

[54] CENTRIFUGE WITH SUCCESSIVE CENTRIFUGATION MODULES

[76] Inventors: Fernando A. Baptista, Rua Pádua Correia, 30, P-4400 Vila Nova de Gaia; João M. Pereira Dias Baptista, Avenida Padre Sá Pereira, P-4740 Espozende, both of Portugal

[21] Appl. No.: 732,469

[22] PCT Filed: May 4, 1995

[86] PCT No.: PCT/PT95/00005

§ 371 Date: Oct. 30, 1996

§ 102(e) Date: Oct. 30, 1996

[87] PCT Pub. No.: WO95/30487

PCT Pub. Date: Nov. 16, 1995

[30] Foreign Application Priority Data

May 5, 1994 [PT] Portugal ..... 101512

[51] Int. Cl.[6] ..... B04B 5/12

[52] U.S. Cl. ..... 494/27; 494/34; 494/65

[58] Field of Search ..... 494/1, 2, 5, 11, 494/22, 23, 27, 30, 31, 34, 44, 56, 60, 65, 68, 70, 71, 72, 79; 210/319, 320; 366/305

[56] References Cited

U.S. PATENT DOCUMENTS

| | | | |
|---|---|---|---|
| 451,542 | 5/1891 | Watters | 494/34 |
| 622,408 | 4/1899 | Aspinall et al. | 494/34 X |
| 3,819,110 | 6/1974 | Baturov et al. . | |
| 4,202,846 | 5/1980 | Shafranovsky et al. . | |
| 4,746,222 | 5/1988 | Cobb et al. | 366/305 X |

FOREIGN PATENT DOCUMENTS

| | | | |
|---|---|---|---|
| 2129483 | 2/1972 | Germany | 494/34 |
| 2050533 | 4/1972 | Germany . | |
| 2409224 | 9/1974 | Germany . | |
| 3147765 | 6/1983 | Germany . | |
| 405160 | 7/1966 | Switzerland . | |
| 1137309 | 12/1968 | United Kingdom . | |
| 2133722 | 8/1984 | United Kingdom . | |
| 2143752 | 2/1985 | United Kingdom . | |

*Primary Examiner*—Charles E. Cooley
*Attorney, Agent, or Firm*—Hoffman, Wasson & Gitler

[57] ABSTRACT

A centrifuge for a fluid uses a series of centrifugal modules to separate the fluid from particles suspended in the fluid. The fluid enters through the bottom of the centrifuge and is subjected to the centrifugal force by a set of rotors. The fluid is forced against a campanula which allows the fluid to travel upwards but forces particles downward. The fluid progresses into another module which exerts a greater centrifugal force until the purified liquid exists through the top of the centrifuge.

8 Claims, 1 Drawing Sheet

CENTRIFUGE WITH SUCCESSIVE CENTRIFUGATION MODULES

FIELD OF THE INVENTION

The invention pertains to systems and appliances for the cleaning and purification of fluids in which the predominant actions for the separation of suspended impurities in a fluid consist of the application of the centrifugal effect.

In already known centrifugation systems, as the ones described in documents DE-A-2409224 and CH-A-405160, these actions are performed along successive and discontinuous time periods to allow for the charge and the discharge of the fluids and the recovery of the impurities.

These time periods need to be longer since automatic valves controlled from outside of the appliance and dedicated to the discharge of impurities are not available which would avoid stopping the rotation of the centrifugation column for the above mentioned purpose.

An inadequate modulation of the centrifugation turbines and the independent pathways for the circulation of the fluid and the impurities also diminishes the yield of the centrifugation operations.

SUMMARY OF THE INVENTION

The objective of the present invention is to solve these problems by means of a system which uses, in association, centrifugation turbines with elements of surfaces which have, as an essential feature, a conical shape, thus creating independent centrifugation modules. The purpose of the conical shape is to speed up the ascending of the flow and, mainly, to accelerate the decent of the impurities, along the respective circulation paths.

The fitting of external gates, not only those of the circulation path of the fluid but also those of the circulation path of the impurities, with automatic valves allows its operation (opening and closing) to be performed from the outside, acting simultaneously, according to a program, without the need of stopping the rotation movement of the centrifugation modules.

A major advantage of the invention, since it allows a greater efficiency and a higher yield of the centrifugation operations, is that it makes the operations of purification and cleaning more economical and, thus, it allows its application to great quantities of deeply troubled liquids or fluids containing a great concentration of impurities.

One of the ways of carrying the invention into execution will be fully described as follows, with reference to the drawings, which only represent one way of execution.

DETAILED DESCRIPTION OF THE INVENTION

Figure 1:
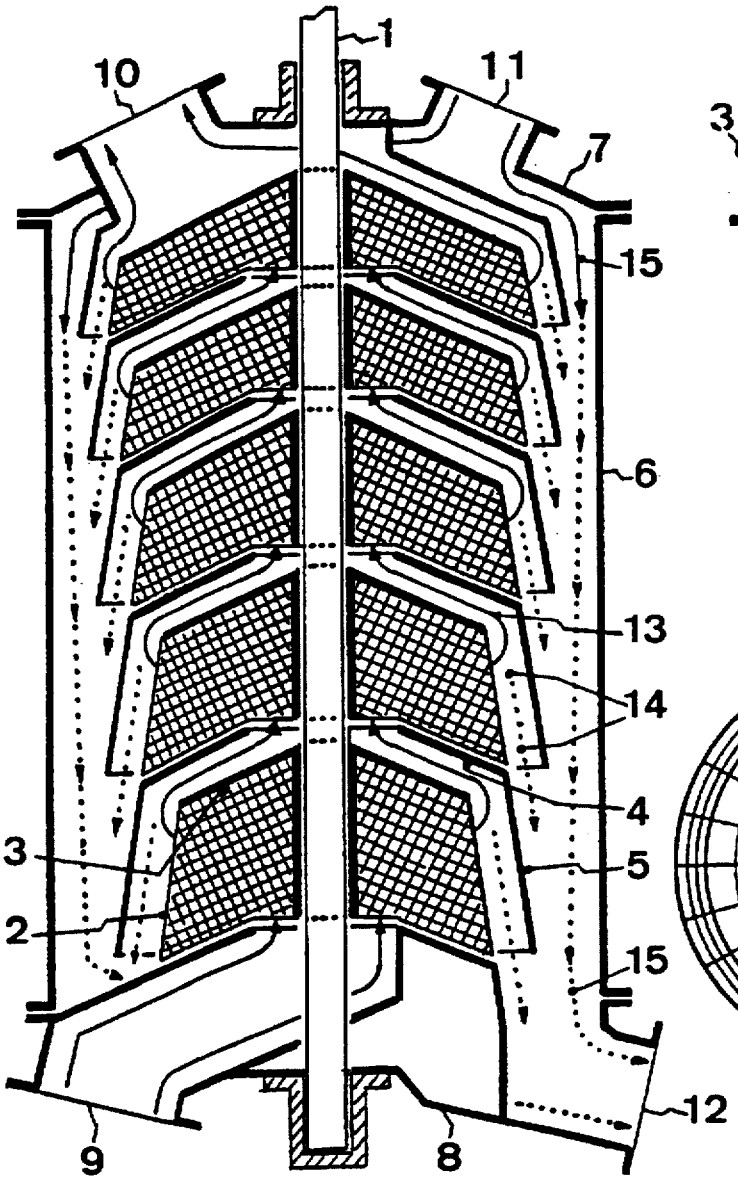
FIG. 1 shows a cross section of the centrifugation modules.

FIG. 1 is a section represents a centrifugation appliance showing the structure and grouping of the centrifugation modules and their common rotatable shaft (1), the cylindrical body (6) and the covers (7), (8), which enclose the column of modules and the rotatable shaft; the entrance portal of the fluid with impurities (9), the course of the fluid circulation in the multiple centrifugation stages (13) and the portal for its exit (10), already purified; the portal for the admission of the fluid which recovers the impurities and transports them (11), its circulation course (15) and the portal for its expelling (12).

As it can be seen by the drawings, an example of a centrifugation column is made up of, in a contiguous and successive way, several modules moved by a common rotatable shaft 1, and separated among themselves by intervallic spaces 13 intended for the circulation of the stream of fluid with impurities, along the several centrifugation stages.

Figure 2:
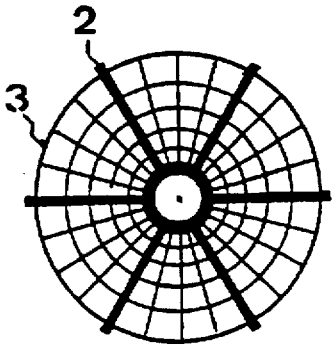
FIG. 2 is a profile view of the rotor and rotor blades and of the conical surface of their cover.
Figure 3:
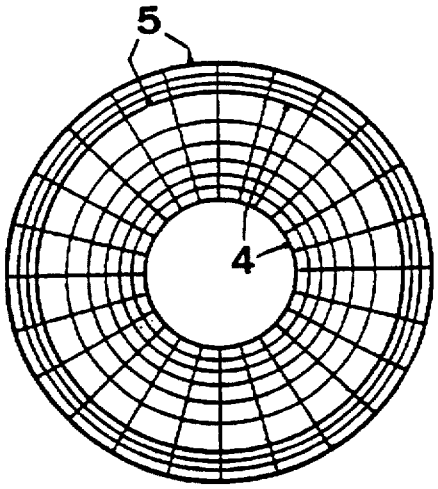
FIG. 3 is a review of the circular crown formed by two surfaces with a different conicity which constitute a campanula that separates two contiguous rotors.

Each centrifugation module is made up of a rotor (FIG. 2) and a campanula (FIG. 3). Each rotor is formed by a set of blades 2 secured to the shaft 1 and rotatable about a rotation axis and, by their superior periphery, to an element with a cone-shaped surface 3. Each campanula is an element axially spaced from the rotor with a surface of equal conicity as the rotors, in the shape of a circular crown 4, attached to the inferior periphery of the rotor blades. It has a conical skirt 5 having a much higher angle of inclination, which encircles the extremities of the blades of the rotor, creating a second intervallic space 14, intended for the guidance of the impurities to the exterior of the module. The elements, constituted by cone-shaped surfaces and attached to the blades of the rotor, follow the rotation movement of the rotor. The campanula acts as a funnel to direct fluid upward. The particles are pushed against the skirt by centrifical force. This force pushes the particles downward in their effort to move radially outward.

The centrifugation column is enclosed in a cylindrical body 6 provided with covers 7, 8, the openings or portals for the entrance of the fluid 10, for the entrance of the cleaning fluid 11 and for the expelling of the impurities 12. A third intervallic space 15, between the centrifugation column and the internal part of the cylindrical body, is intended for the circulation of the impurities for later expelling.

Preferably, the centrifugation diameter of each module increases from the first to the last one, positioned in the superior part of the column, thus obtaining the progressive increase in the centrifugation speed.

The first module accomplishes the centrifugation and the separation of the impurities of greater volume or density which the fluid contains. Free from those impurities, the fluid progressively moves to the contiguous module where an increased centrifugation speed separates the impurities of decreasing volume or density.

This process of progressive increases in the centrifugation speed is repeated until the last module, being of diameter and rotation speed so that it may achieve the separation of the impurities of smaller volume or of less density which the fluid might contain. Also being taken into account in that estimate is the fluid's own density, the impurities concentration and the relative time length of the centrifugation work, which is settled by varying the speed or debit of the fluid circulation.

For the opening and closing of the portals, according to a program, valves with automatic control are foreseen, which allows to quickly accomplish the expelling of the accumulated impurities. In order to do that, portals 9 and 10 are closed and portals 11 and 12 are immediately opened allowing the cleaning fluid to get through portal 11 and drag the accumulated impurities and expel them through portal 12 in a short period of time, thus avoiding the stopping of the centrifugation column. The cleaning fluid would enter through the portal 11 and flow in the third intervallic space. As it flowed, it would collect particles and remove them through the drain (12).

The invention claimed is:

1. A device for the centrifugation of a fluid comprising:

an outer casing, having a fluid inlet, a fluid outlet and a rotatable shaft and a series of centrifugation modules along the rotatable shaft, each module comprising;

a rotor having rotor blades attached to the rotatable shaft; the rotor having a top surface having an angle of inclination to the shaft;

a campanula, the campanula axially spaced from the rotor and having a top surface having an angle of inclination to the shaft, the angle of inclination of the rotor top surface being substantially equal to the angle of inclination of the campanula top surface;

each module being spaced from the outer casing.

2. The device of claim 1 wherein the rotor and campanula have a conical shape.

3. The device of claim 1 further comprising a drain in the outer casing.

4. The device of claim 3 further comprising a cleaning fluid inlet in the outer casing.

5. The device of claim 1 wherein successive modules have a greater radial extent than a previous module.

6. The device of claim 1 wherein the fluid inlet is at the bottom of the outer casing.

7. The device of claim 6 wherein the fluid outlet is at the top of the outer casing.

8. The device of claim 2 wherein the campanula has a skirt, the skirt is attached to the top surface of the campanula, and is disposed steeper than the angle of inclination of the rotor top surface.

* * * * *